US005425657A

United States Patent [19]

Davis et al.

[11] Patent Number: 5,425,657

[45] Date of Patent: Jun. 20, 1995

[54] ELECTRICAL CONNECTOR ASSEMBLY AND METHOD FOR TERMINATING A MULTI-CONDUCTOR CABLE

[75] Inventors: Wayne S. Davis, Harrisburg; Edward E. Grunden, Highspire, both of Pa.

[73] Assignee: The Whitaker Corporation, Wilmington, Del.

[21] Appl. No.: 225,370

[22] Filed: Apr. 8, 1994

Related U.S. Application Data

[63] Continuation of Ser. No. 46,831, Apr. 12, 1993, abandoned.

[51] Int. Cl.[6] ..... H01R 9/03

[52] U.S. Cl. ..... 439/610; 439/405; 439/456

[58] Field of Search ..... 439/607–610, 439/395–405, 452, 456, 460

[56] References Cited

U.S. PATENT DOCUMENTS

| | | | |
|---|---|---|---|
| 4,193,201 | 3/1980 | Van Horn | 439/403 |
| 4,327,956 | 5/1982 | Sitzler | 439/404 |
| 4,671,596 | 6/1987 | Soma | 439/404 |
| 4,749,371 | 6/1988 | Hirai et al. | 439/402 |
| 4,753,608 | 6/1988 | Yamaguchi | 439/395 |
| 4,773,876 | 9/1988 | Nakamura et al. | 439/417 |
| 4,781,615 | 11/1988 | Davis et al. | 439/395 |
| 4,808,122 | 2/1989 | Tomizu et al. | 439/417 |
| 4,902,243 | 2/1990 | Davis | 439/405 |
| 4,932,892 | 6/1990 | Hatch | 439/395 |
| 4,938,711 | 7/1990 | Davis et al. | 439/405 |
| 4,960,389 | 10/1990 | Frantz et al. | 439/610 |
| 4,981,447 | 1/1991 | Ichitsubo | 439/607 |
| 4,995,827 | 2/1991 | Rudoy | 439/405 |
| 5,017,156 | 5/1991 | Sugiyama | 439/607 |
| 5,041,009 | 8/1991 | McCleerey | 439/405 |
| 5,052,949 | 10/1991 | Lopata et al. | 459/610 |
| 5,073,130 | 12/1991 | Nakamura | 439/607 |
| 5,178,560 | 1/1993 | Yaegashi et al. | 439/497 |

FOREIGN PATENT DOCUMENTS

| | | | |
|---|---|---|---|
| 0039978 | 11/1981 | European Pat. Off. | H01R 4/24 |
| 0168048 | 1/1986 | European Pat. Off. | H01R 23/66 |
| 0356025 | 2/1990 | European Pat. Off. | H01R 9/07 |

*Primary Examiner*—David L. Pirlot

[57] ABSTRACT

An electrical connector assembly (22) for terminating a multi-conductor cable (20) includes a cover block member (32) with grooves (52) for each holding a respective one of the cable conductors (54). The grooves extend along three sides of the generally rectangular cover block member so that the conductors may be wrapped thereabout. A housing (24) containing insulation displacement contacts (34) is pressed against the cover block member to engage the cable conductors and a pair of metal backshells (26, 28) are fastened together over both the cover block member and the housing to hold them together. The metal backshells are also crimped over the cable to provide primary strain relief therefore. The bending of the conductors around the cover block member serves two functions—it provides partial strain relief for the conductors during assembly and it prevents the exposed wire ends of the conductors from contacting the metal backshell.

10 Claims, 11 Drawing Sheets

ELECTRICAL CONNECTOR ASSEMBLY AND METHOD FOR TERMINATING A MULTI-CONDUCTOR CABLE

This application is a continuation of application Ser. No. 08/046,831 filed Apr. 12, 1993, now abandoned.

BACKGROUND OF THE INVENTION

This invention relates to electrical connectors and, more particularly, to a connector which aligns the insulated conductors of a multi-conductor cable with insulation displacement contacts in a minimal amount of space and provides partial strain relief to the conductors during the assembly operation.

In the past, the connection of a wire to a contact terminal was conventionally done by means of a crimping operation. This operation requires that the wire be trimmed, stripped of a predetermined length of insulation at its free end, placed next to the contact terminal, and then folding the crimp tabs of the contact terminal over the bare wire. It is readily apparent that this connection procedure involves a large number of steps and requires precise positioning. When a multi-conductor cable is terminated to a connector, these steps must be repeated for each and every one of the conductors. To alleviate some of these shortcomings, in recent years the use of insulation displacement contacts has become increasingly popular. Such contacts generally have at one end thereof an insulation displacing part which has a longitudinal slit into which an insulation covered conductor is press fitted. The edges of the slit displace the insulation and make contact with the underlying wire. While such a contact is generally satisfactory in an electrical sense, it suffers from the disadvantage that it does not achieve, by itself, a good mechanical bond. Accordingly, the mechanical bond between the conductor and the contact terminal must be attained through some independent means.

The present invention is particularly concerned with an in-line plug connector having insulation displacement contacts for terminating a multi-conductor cable. With such a connector, movement of the connector when being mated with or separated from a complementary mating connector is in a direction generally along the length of the cable. Those of skill in the art will recognize that in many applications the internal space for terminating the wires in an in-line plug connector is limited when compared, for example, with a plug connector which is offset 90° from the cable direction. It is therefore a primary object of this invention to provide a connector of the type described which does not require much internal space for terminating the cable conductors.

In an in-line plug connector of the type described, if during the assembly operation the cable is pulled before the primary strain relief is effected, this can adversely affect the insulation displacement contact terminations. It is therefore another object of the present invention to provide a connector wherein partial strain relief is provided during the assembly operation.

Connectors typically include dielectric insulating housings for holding the contact terminals. However, they also typically include a metal shield surrounding the housing. As discussed above, space in an in-line plug connector is limited and therefore it is often not possible to have sufficient room within the metal shield to provide insulation for separating the exposed wire ends of the cable conductors from the metal shield. It is therefore a further object of the present invention to provide a connector of the type described wherein the exposed wire ends of the cable conductors cannot contact the metal shield.

SUMMARY OF THE INVENTION

The foregoing and additional objects are attained in accordance with the principles of this invention by providing an electrical connector assembly for terminating a cable having a predetermined number of insulation covered conductors. The connector assembly includes an insulating termination cover block member of generally rectangular cross section which is formed with a predetermined number of parallel grooves each adapted to hold a respective one of the conductors. Each of the grooves extends along three sides of the cover block member so that each groove has a middle section and two substantially parallel end sections each substantially perpendicular to the middle section. A conductor held in a groove therefore has two substantially right angled bends. The assembly further includes the predetermined number of terminals each having a contacting part for contacting a contacting part of a mating connector and an insulation displacing part for connection to a respective one of the conductors, and an insulating housing for holding the terminals so that the insulation displacing parts project outwardly from a first end thereof and the contacting parts are accessible at a second end thereof opposite the first end. The cover block member and the housing are formed with complementary mating formations so that the cover block member and the housing may be aligned and held together in a defined orientation with the housing first end being adjacent to the cable conductors between the conductor bends. Clamp means are provided for holding the cover block member and the housing together so that each of the insulation displacing parts is connected to a respective one of the conductors. Thus, the conductors enter the electrical connector assembly and are wrapped around the cover block member so that the exposed wire ends are pointed back toward the incoming direction of the conductors, with that portion of each conductor being substantially parallel to the clamp means. The insulation of the conductors surrounding the exposed wire ends prevents the clamp means, which is in effect the metal shield, from contacting the wire ends. The insulation displacing parts of the terminals are connected to the conductors in a region which is transverse to the direction of the cable. The bends of the conductors around the cover block member provide partial strain relief during assembly.

BRIEF DESCRIPTION OF THE DRAWINGS

The foregoing will be more readily apparent upon reading the following description in conjunction with the drawings in which like elements in different figures are identified by the same reference numeral and wherein.

DETAILED DESCRIPTION

Figure 1:
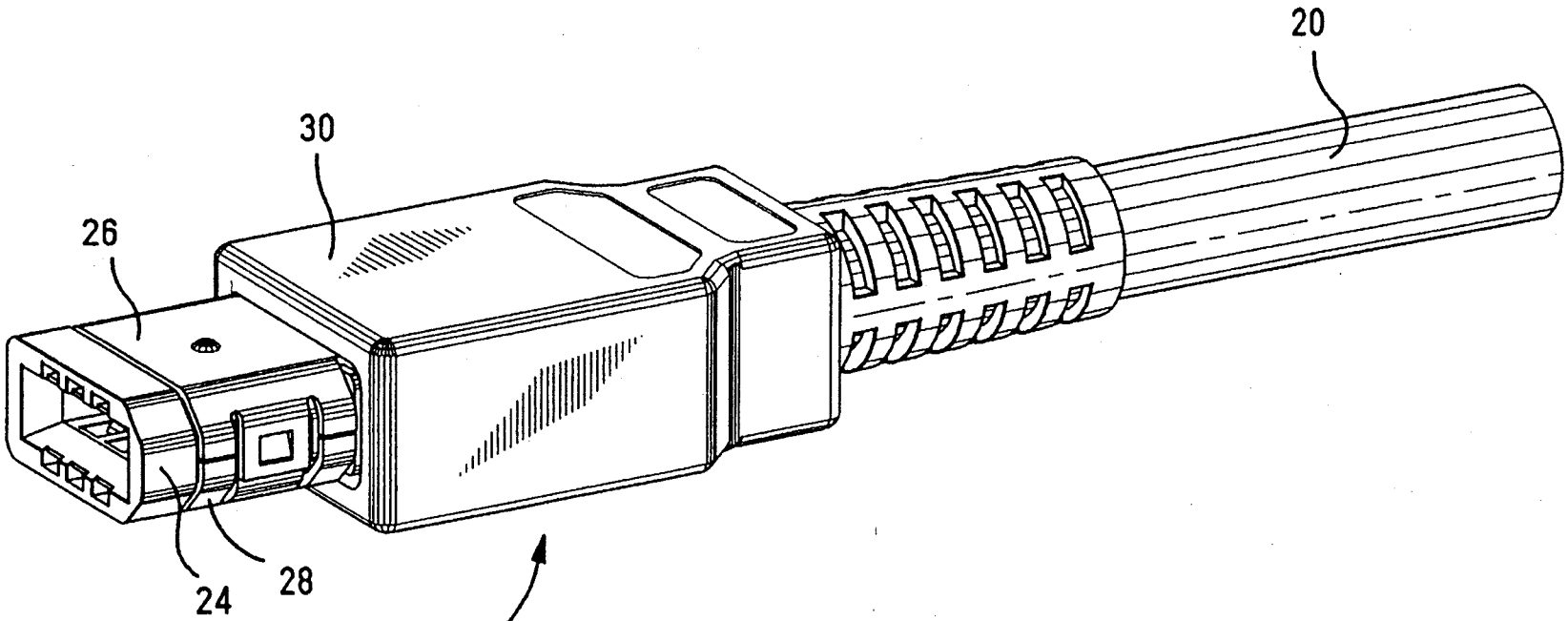
FIG. 1 is a perspective view of a complete connector assembly according to the present invention.

Referring now to the drawings, FIG. 1 shows a multi-conductor cable 20 terminated to an electrical connector assembly 22 constructed according to this invention. The connector assembly 22 is of the in-line type and includes a partially exposed insulating housing 24 covered by a two-part metal backshell 26, 28, all of which is partially covered by an insulating boot 30. The exposed end of the housing 24 is adapted to mate with a complementary mating connector. At this exposed end of the housing 24, internal terminals, as will be described in full detail hereinafter, are accessible for connection to complementary terminals of the mating connector.

Figure 2:
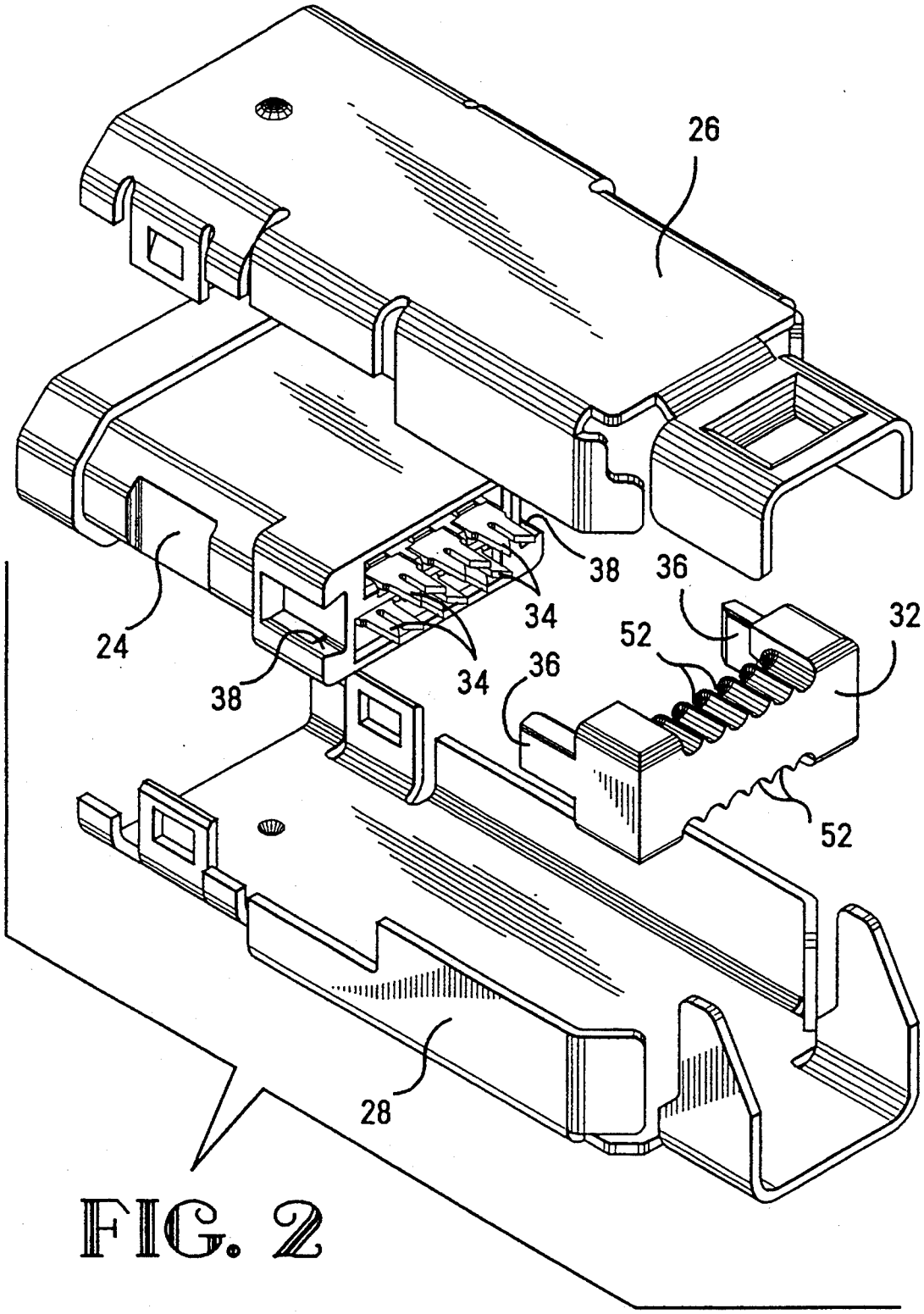
FIG. 2 is an exploded perspective view of a portion of the assembly of FIG. 1.

FIG. 2 is an exploded perspective view of part of the connector assembly 22. Specifically, FIG. 2 illustrates the backshells 26, 28 exploded away from the housing 24 and further illustrates an insulating cover block member 32 which, as will be described hereinafter, is utilized to hold and orient the cable conductors so as to provide partial strain relief during assembly and also to properly position the conductors relative to the insulation displacement contact terminals 34 which are held within the housing 24. As shown, the terminals 34 have their insulation displacing parts projecting outwardly from a first end of the housing 24. The cover block member 32 is illustratively formed with a pair of projections 36 and the housing 24 is formed with a pair of recesses 38 complemental to the projections 36 so that the cover block member 32 and the housing 24 may be properly aligned and held together in a defined orientation. Although projections 36 and recesses 38 are illustrated herein, it is understood that any other appropriate complementary mating formations may be utilized.

Figure 3:
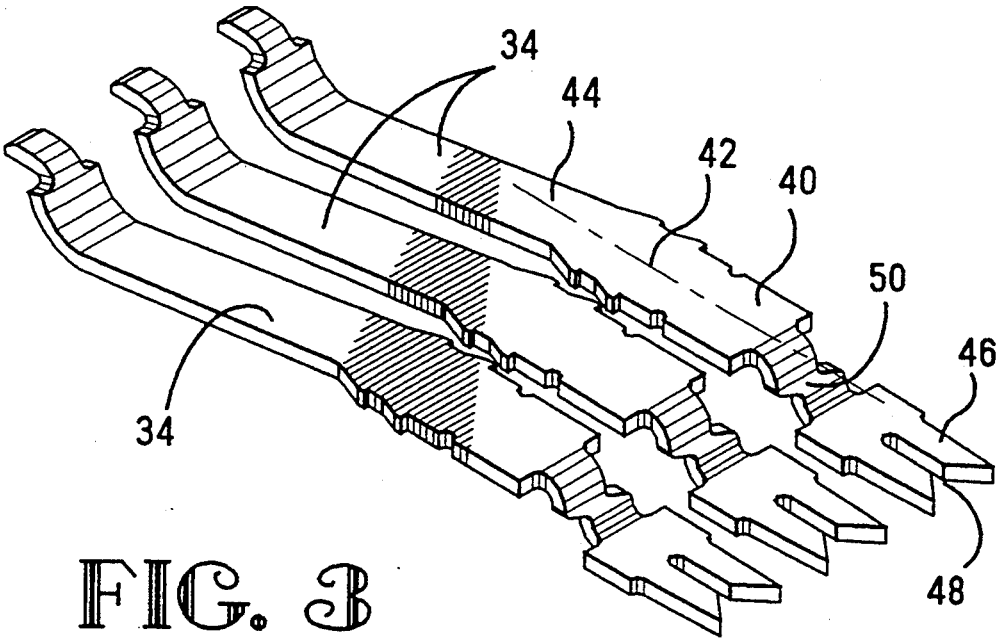
FIG. 3 is a perspective view showing insulation displacement contact terminals which may be utilized in the assembly of FIGS. 1 and 2.
Figure 6:
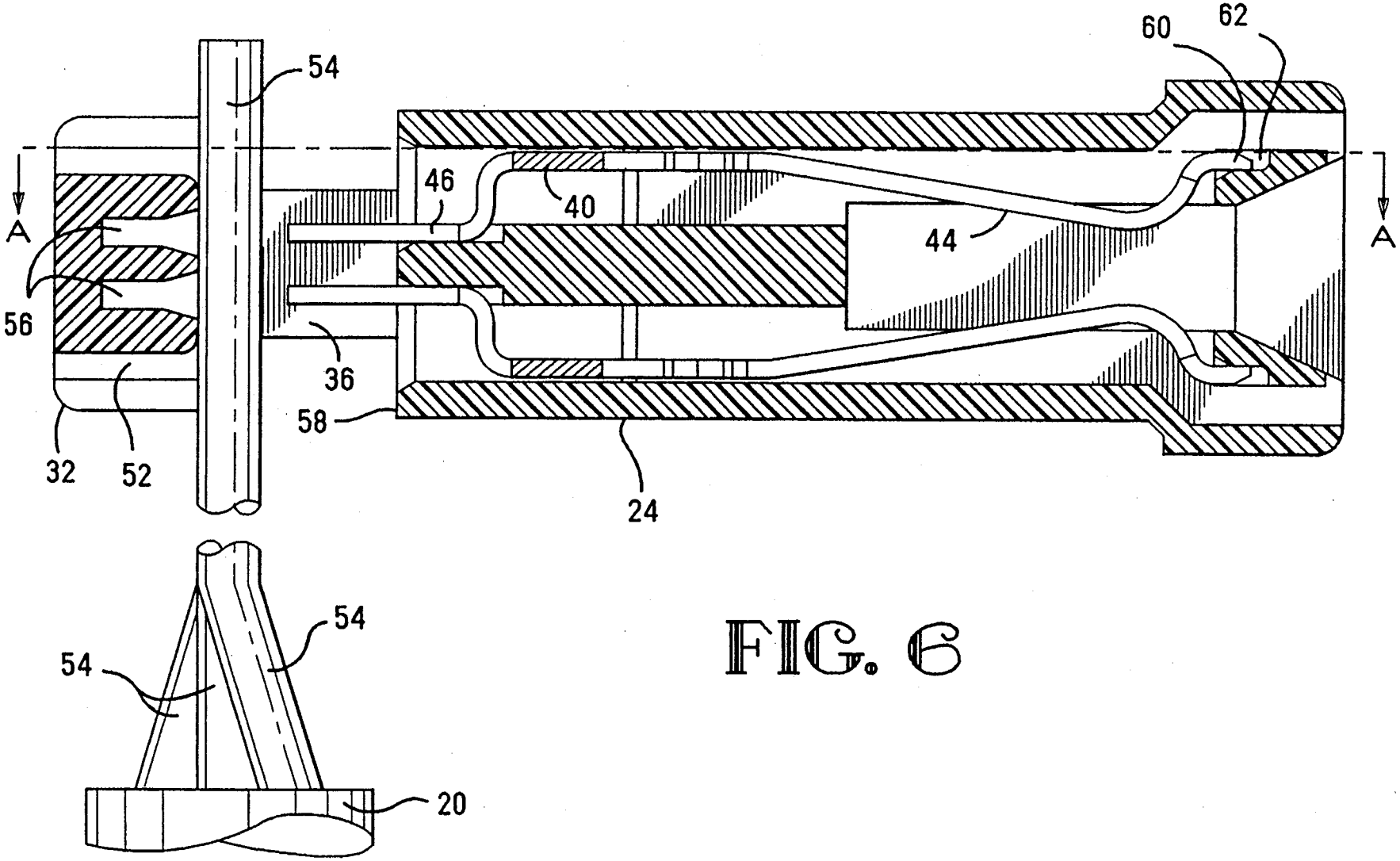
FIG. 6 is a cross sectional view showing the housing, the cover block member and the multi-conductor cable at an initial stage of the assembly operation.
Figure 6A:
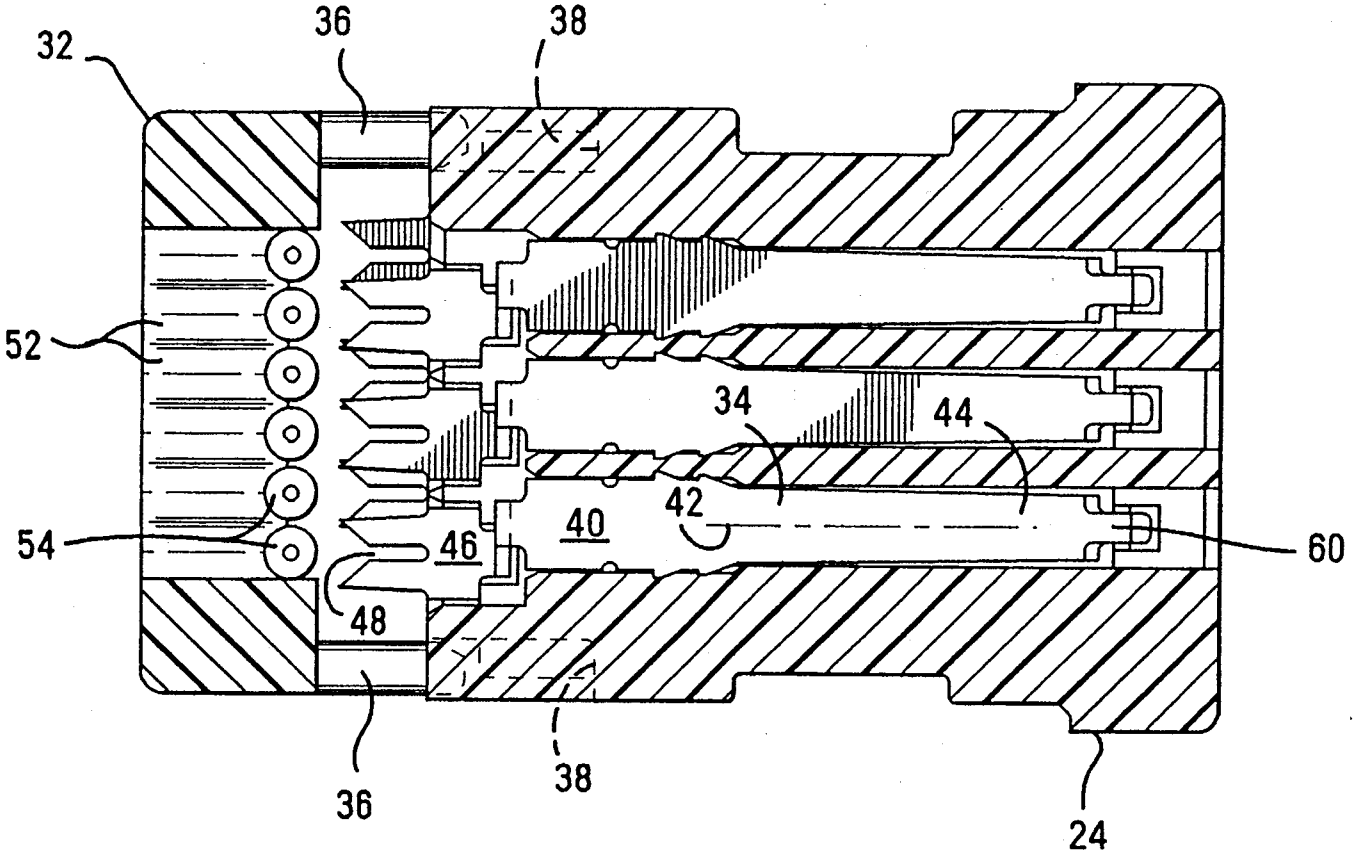
FIG. 6A is a cross sectional view taken along the line A—A of FIG. 6.

FIG. 3 shows illustrative terminals 34 which may be utilized in the connector assembly 22. Each of the terminals 34 includes a main body portion 40. Preferably, the main body portion 40 is generally planar with a central longitudinal axis 42. Extending from a first end of the main body portion 40 is a contacting part 44 which is the part of the terminal 34 which mates with a complementary terminal in the mating connector. The terminal 34 also includes an auxiliary body portion 46 which is also preferably generally planar and is parallel to the main body portion 40. Formed on the auxiliary body portion 46 is the insulation displacing part of the terminal 34 which is bifurcated with a V-shaped open end and with a longitudinal slit 48 extending inwardly from the V-shaped end. The V-shaped end allows for easy reception of an insulation covered conductor. When such a conductor is pressed into the slit 48, the insulation thereof is displaced and only the central conductor wire goes into the slit 48, the width of which is slightly less than the diameter of the wire so that good electrical contact is made therebetween. The terminal 34 also includes a connecting portion 50 which extends between the main body portion 40 and the auxiliary body portion 46. The connecting portion 50 connects the main body portion 40 and the auxiliary body portion 46 in such a manner that their planes are offset from each other while being generally parallel and also so that when viewed in plan the slit 48 is offset from the longitudinal axis 42 by half the spacing between the cable conductors, as best shown in FIG. 6A and as described in full detail hereinafter.

Figure 4:
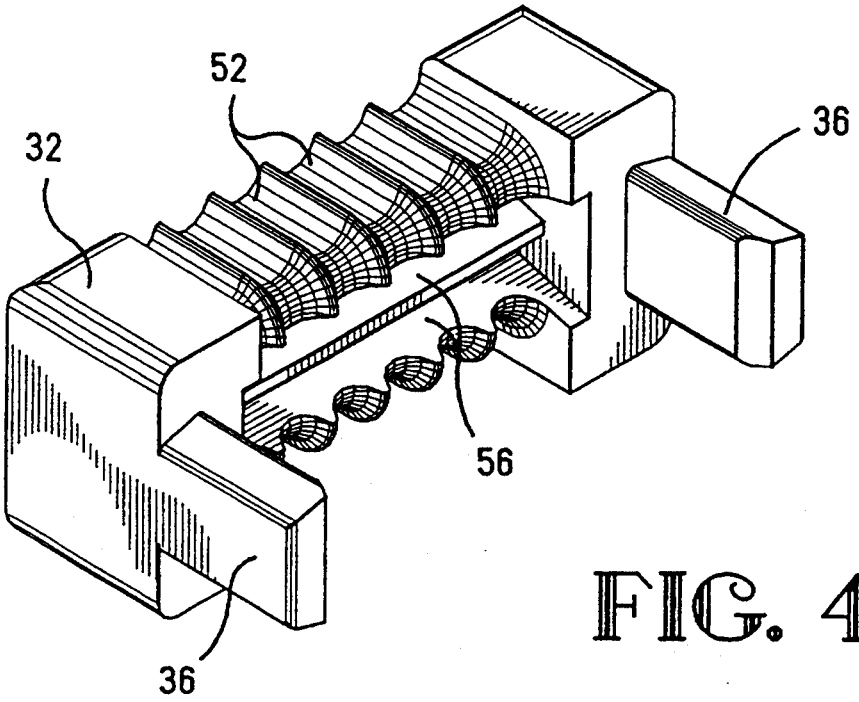
FIG. 4 is a perspective view of an illustrative cover block member, viewed from the side at which electrical connections to the terminals are made.
Figure 5:
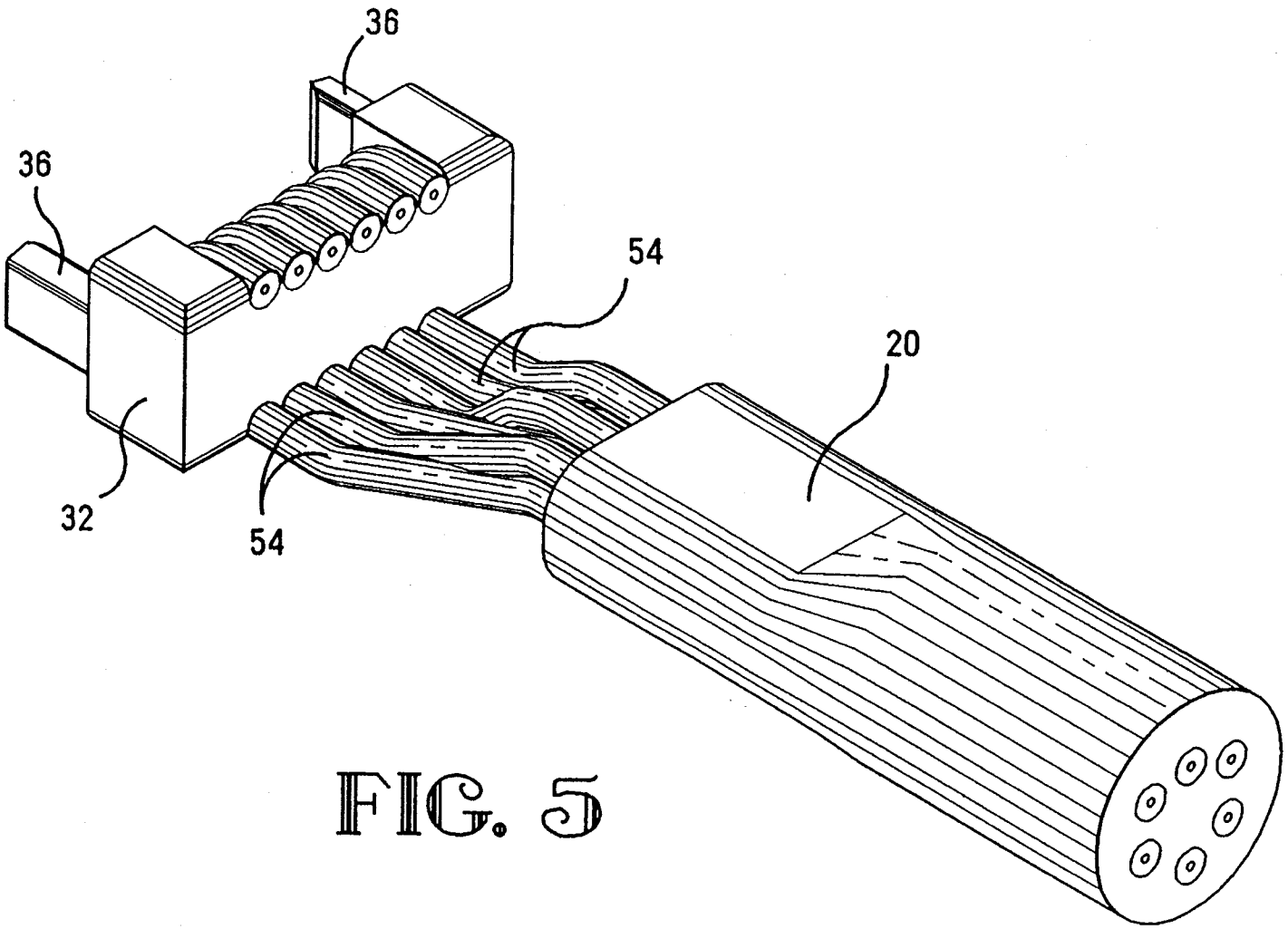
FIG. 5 is a perspective view of the cover block member viewed from the opposite side of FIG. 4 and showing how the cable conductors are wrapped thereabout.

FIGS. 4 and 5 show the termination cover block member 32 which has a generally rectangular cross section and is formed with a plurality of grooves 52 equal in number to the number of conductors 54 of the cable 20. The grooves 52 are parallel to each other and each is adapted to hold a respective one of the conductors 54. Each of the grooves 52 extends along three sides of the cover block member 32 so that it has a middle section and two substantially parallel end sections each substantially perpendicular to the middle section. Thus, as shown in FIG. 5, each of the conductors 54 held in the grooves 52 has two substantially right angle bends so that the free end of each of the conductors 54 is pointed back toward the main portion of the conductor 54. The cover block member 32 is further formed with a pair of recesses 56 intersecting the middle sections of the grooves 52 for accepting the insulation displacing parts of the terminals 34 after they have connected with the respective conductors 54, as will be described in full detail hereinafter.

For purposes of illustration, the cable 20 will be considered as having six insulated conductors 54. Accordingly, there will be six grooves 52 in the cover block member 32 and there will be six terminals 34 within the housing 24. As shown in FIG. 6, each of the terminals 34 is installed in the housing 24 so that its insulation displacing part on the auxiliary body portion 46 extends outwardly beyond the first end 58 of the housing 24. The terminals 34 are installed in the housing 24 from the first end 58 so that the contacting parts 44 enter first. The distal ends 60 of the contacting parts 44 are supported on ledges 62 provided therefor, the end walls of which provide abutments for preventing further inward movement of the terminals 34. The terminals 34 are installed in two rows (upper and lower as viewed in FIG. 6) within the housing 24, with the terminals 34 in the upper row being inverted with respect to the terminals 34 in the lower row. Accordingly, when viewed in plan, as in FIG. 6A, the insulation displacing parts of the upper row of terminals 34 are offset in a first direction with respect to the central longitudinal axis 42, whereas the insulation displacing parts of the lower row of terminals 34 are offset in the opposite direction. Since the longitudinal axes 42 of each pair of upper and lower terminals 34 are aligned in plan, and since the offsets are half the spacing between the grooves 52, as shown in FIG. 6A the slits 48 of the insulation displacing parts are each aligned with a respective groove 52 when the cover block member 32 is properly oriented with respect to the housing 24.

Figure 7:
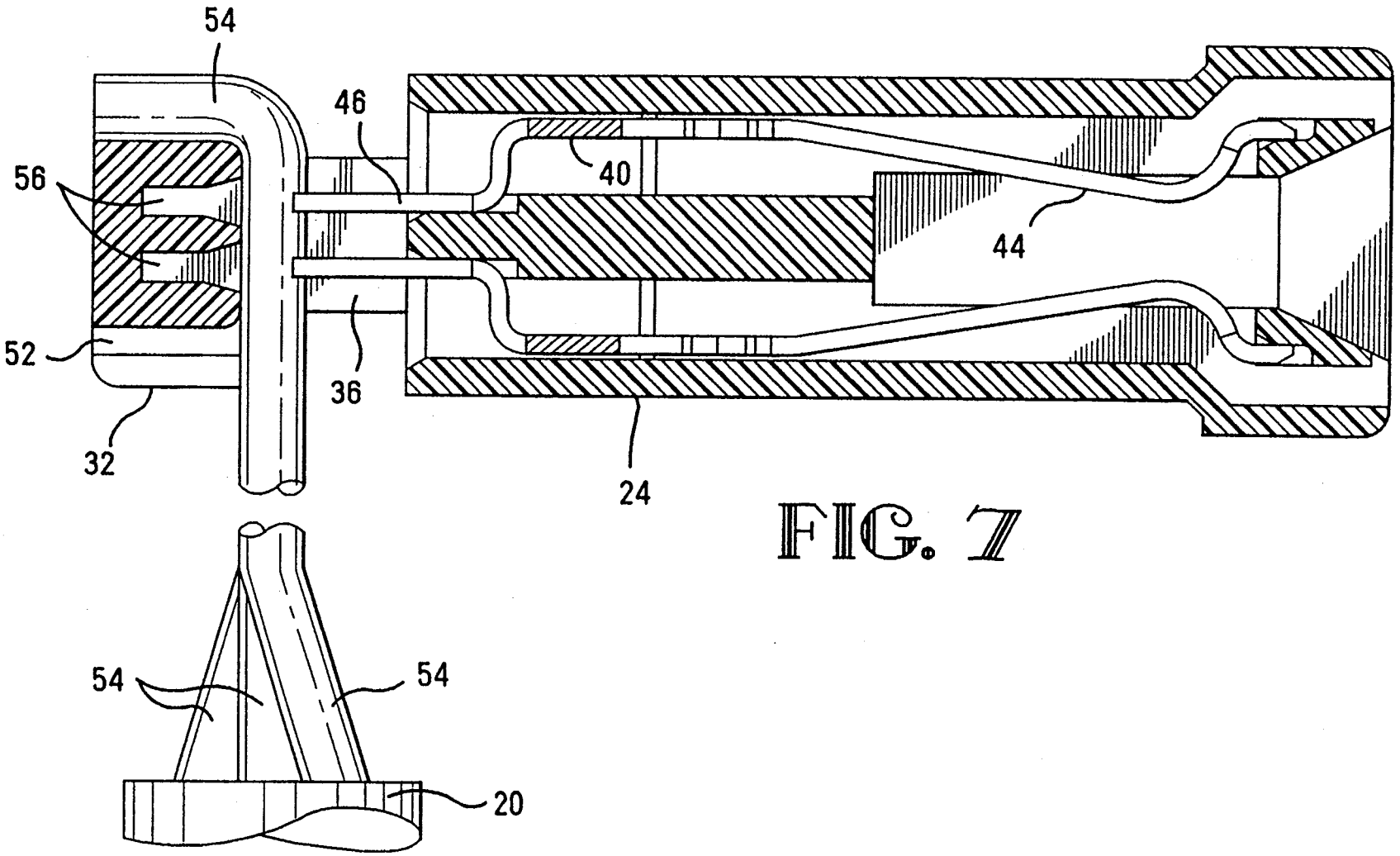
FIG. 7 is a view similar to FIG. 6 taken at a subsequent stage of the assembly operation.

With the terminals 34 installed in the housing 24, the conductors 54 of the cable 20 are fanned out and placed in respective middle sections of the grooves 52 of the cover block member 32. With the conductors 54 in the grooves 52, the cover block member 32 is moved toward the housing 24 so that the projections 36 align with and enter the recesses 38. As shown in FIG. 7, the conductors 54 enter the V-shaped openings of the insulation displacing parts of the terminals 34. At the same time, the conductors 54 are bent around the upper right corners of the grooves 52, as viewed in FIG. 7, and are held in the upper end sections of the grooves 52 by tooling (not shown in FIG. 7).

Figure 8:
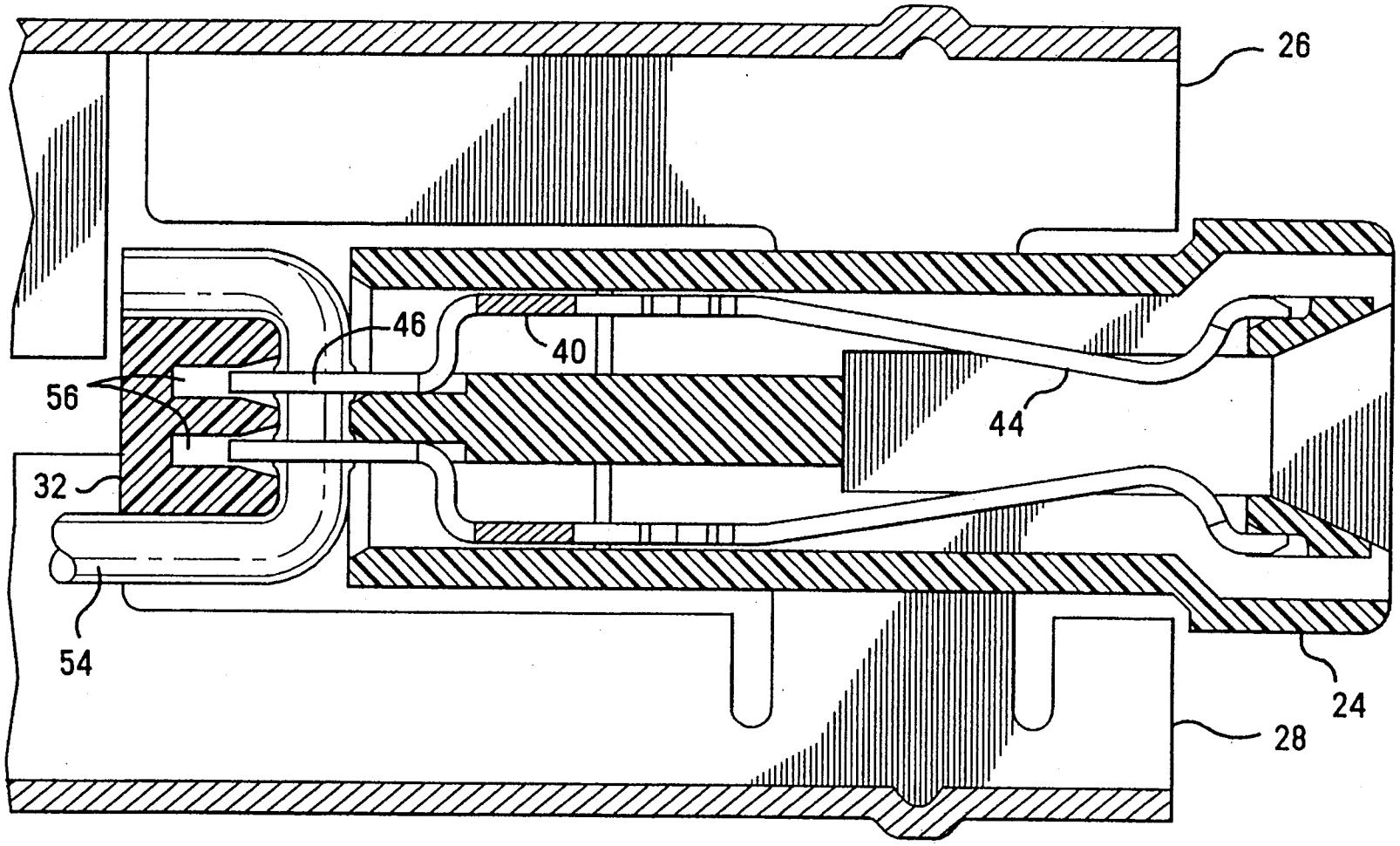
FIG. 8 is a view similar to FIGS. 6 and 7 taken at a later stage of the assembly operation showing the terminals connected to the conductors and the outer clamp shield in place for installation.

FIG. 8 illustrates the stage in the assembly operation wherein the insulation displacing parts of the terminals 34 have displaced the insulation of their respective conductors 54, have connected to the central wires within the respective conductors 54, and have entered into the respective ones of the recesses 56 in the cover block member 32. As illustrated, there are two recesses 56, one aligned with each of the two rows of insulation displacing parts. At this stage, the backshells 26 and 28 are placed over the housing 24 in preparation for installation, and at the same time the conductors 54 are bent around the lower right corners of the grooves 52 and placed in the respective other end sections of their respective grooves 52. This second bend of the conductors 54 provides partial strain relief during the assembly operation so that if the cable 20 is inadvertently pulled, the conductors 54 are held from adversely affecting their connections to the terminals 34.

Figure 9:
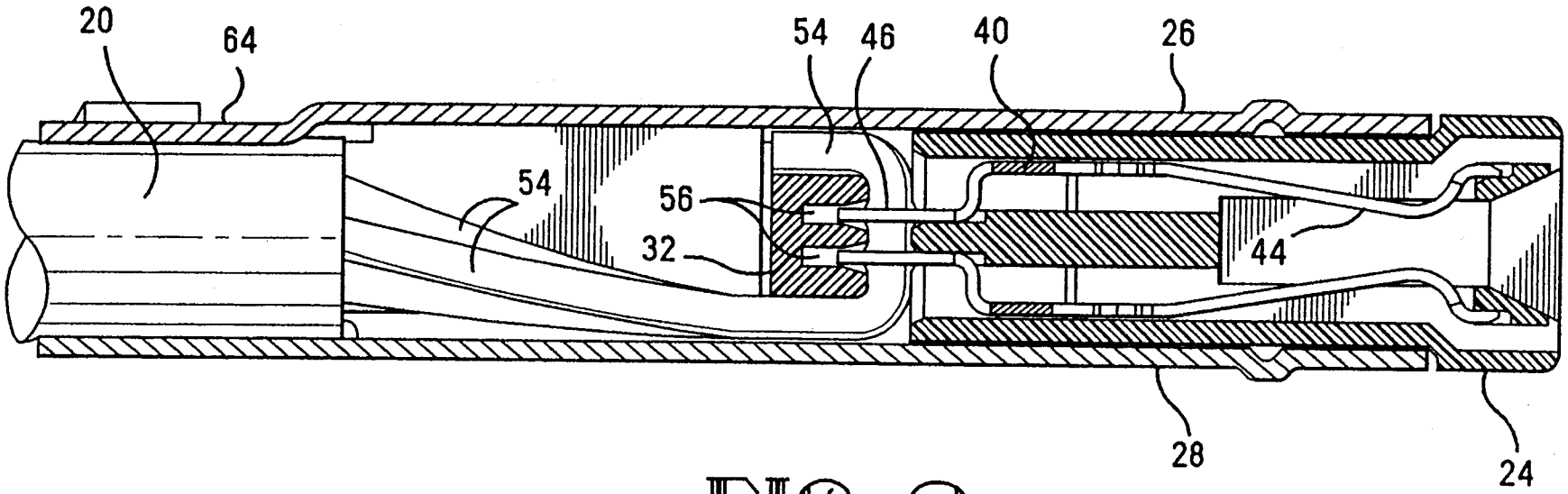
FIG. 9 is a view similar to FIGS. 6–8 at the stage in the assembly operation where the shield has been installed to clamp all of the elements in their final positions and provide primary strain relief to the cable.

As shown in FIG. 9, in the completed assembly, before installation of the boot 30, the backshells 26 and 28 are crimped over the cable 20 in the region 64 to provide the primary strain relief for the connector assembly. It is noted from FIG. 9 that the individual conductors 54 leave the cable 20 and are wrapped around the cover block member 32 with two right angle bends so that the exposed wire ends of each of the insulation covered conductors 54 is pointing back toward the incoming direction of the conductors. Thus, the insulation surrounding those exposed wire ends prevents the metal backshell 26 from contacting the exposed wire ends.

Figure 10:
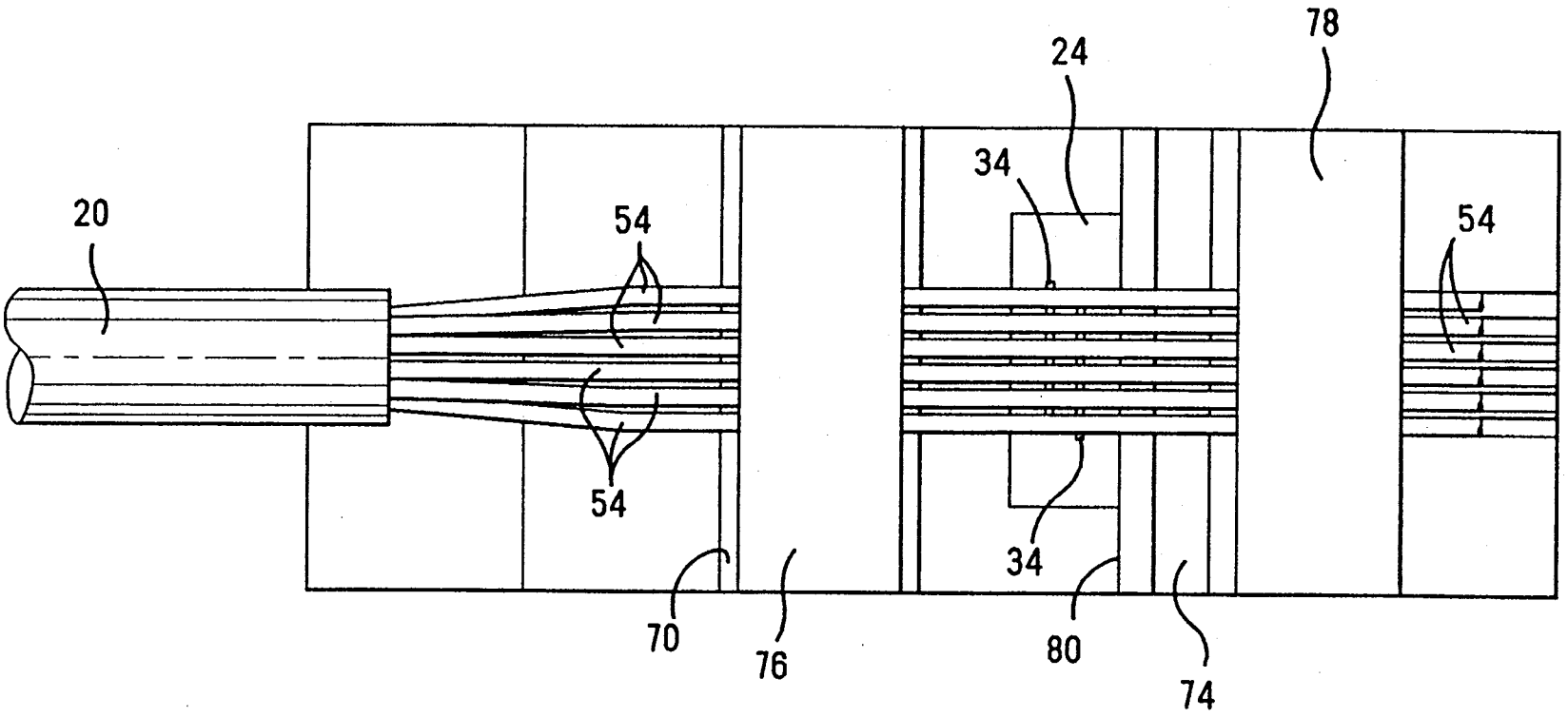
FIG. 10 is a top view schematically depicting an assembly station for the connector according to this invention.
Figure 11:
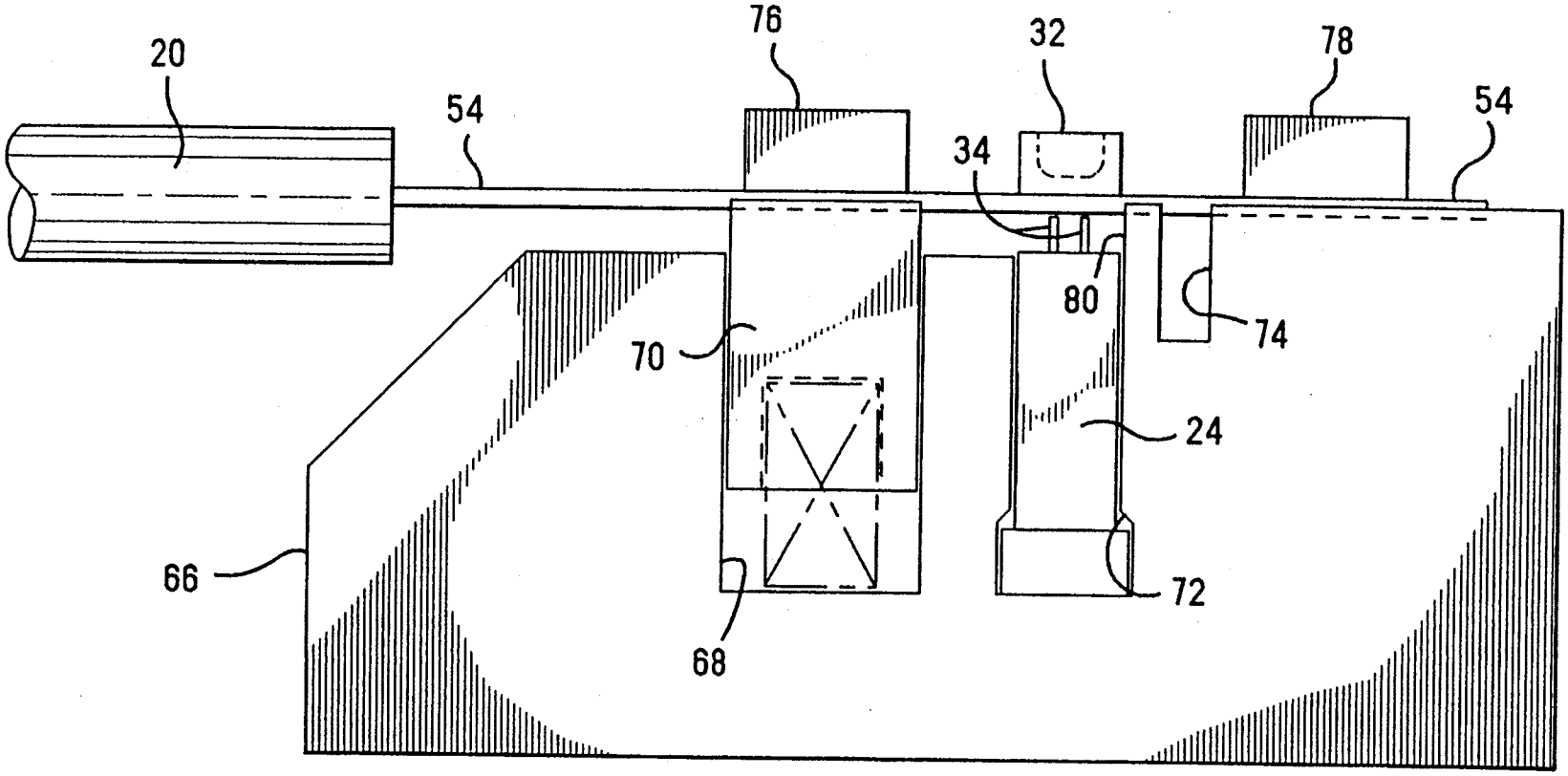
FIG. 11 is a side view of the station of FIG. 10.

FIGS. 10 and 11 schematically show top and side views, respectively, of an assembly station which may be utilized to assemble the aforedescribed electrical connector assembly. Thus, the station includes a table 66 having a recess 68 holding an upwardly spring biased lower clamp member 70. The upper surface of the clamp member 70 preferably includes a plurality of parallel grooves (not shown) into which the conductors 54 of the cable 20 may be placed when fanned out. The table 66 also includes a second recess 72 for holding the housing 24 against a support surface with the insulation displacing parts of the terminals 34 extending upwardly away from the support surface. The table 66 further includes a third recess 74 beyond the second recess 72. The function of the third recess 74 is to accept therein a cutting tool, as will be described hereinafter. Accordingly, the distance between the recesses 72 and 74 is equal to the length of an end section of the grooves 52 of the cover block member 32. The upper surface of the table 66 between the recesses 72 and 74 and to the right of the recess 74 is formed with parallel grooves spaced the same as the grooves 52 so that the fanned out conductors 54 may be positioned therein.

The assembly operation proceeds as follows. The terminals 34 are installed in the housing 24 and the housing 24 is placed within the recess 72 against the internal support surface therein. The sheathing of the cable 20 is removed to expose a length of the conductors 54 and the conductors 54 are fanned out and laid in the grooves in the upper surface of the lower clamp member 70 and the upper surface of the table 66. Upper clamp members 76 and 78 are then positioned over the lower clamp member 70 and the upper surface of the table 66, respectively, as shown in FIGS. 10 and 11, to hold the conductors 54. The cover block member 32 is then positioned over the conductors 54 with the grooves 52 aligned with respective ones of the conductors 54 and the cover block member 32 properly oriented over the housing 24. A cutting tool (not shown) is then moved into the recess 74 to cut the conductors 54 so as to leave them with free ends of lengths substantially equal to the lengths of the end sections of the grooves 52. The cover block member 32 is then pressed toward the housing 24 so that the insulation displacing parts of the terminals 34 connect to respective ones of the conductors 54. At the same time, due to the presence of the wall 80 at the side of the recess 72, the conductors 54 are bent around the lower right corner of the cover block member 32 (as viewed in FIG. 11). After the cover block member 32 is mated with the housing 24, the clamp 76 is removed, the housing 24 is taken out of the recess 72 with the cover block member 32 in mating engagement therewith, and the conductors 54 are bent around the lower left corner of the cover block member 32. The backshells 26 and 28 are then installed and crimped to hold the assembly together, and the boot 30 is installed. The first bending operation as described above prevents the exposed wire ends of the conductors 54 from contacting the metal backshell. The second bending operation provides partial strain relief so that pulling on the cable 20 before the primary strain relief provided by crimping the backshells 26 and 28 is applied does not induce stress on the connection of the insulation displacing parts of the terminals 34 as connected to the conductors 54.

Accordingly, there has been disclosed an electrical connector which aligns the insulated conductors of a multi-conductor cable with insulation displacement contacts in a minimal amount of space and provides partial strain relief to the conductors during the assembly operation. While an exemplary embodiment has been disclosed herein, it will be appreciated by those skilled in the art that various modifications and adaptations to the disclosed embodiment may be made and it is only intended that this invention be limited by the scope of the appended claims.

We claim:

1. An electrical connector assembly for terminating a cable having a predetermined number of insulation covered conductors, comprising:

an insulating termination cover block member formed with a predetermined number of parallel grooves each adapted to hold a respective one of said conductors, each of said grooves extending along said cover block member; a predetermined number of terminals each having a contacting part for contacting a contacting part of a mating connector and an insulation displacing part for connection to a respective one of said conductors;

an insulating housing for holding said terminals so that said insulation displacing parts project outwardly from a first end of said housing and said contacting parts are accessible at a second end of said housing; said cover block member and said housing being formed with complementary mating formations so that said cover block member and said housing may be aligned and held together in a defined orientation with said housing first end being adjacent to said conductors; said cover block member and said housing being held together so that each of said insulation displacing parts is connected to a respective one of said conductors, a conductive shield, the conductors being wrapped on the cover block member to position insulation on the conductors between the shield and ends of the conductors to prevent the shield from contacting the ends of the conductors; the shield extending over the housing, over the cover block member and over said insulation between the clamp and the ends of the conductors; the conductors extending toward the cover block member from an incoming direction, and the conductors being wrapped around the cover block member so that said ends of the conductors point back toward the incoming direction, whereby the housing and cover block member extend straight with the incoming direction; the shield comprising, conductive backshells extending over the housing and over the cover block member and over said insulation between the clamp and the ends of the conductors, and the backshells engaging and providing strain relief for a cable from which the conductors extend.

2. An electrical connector comprising: an insulating housing, an insulating cover block member, electrical terminals for connection to conductors having exposed ends of the conductors exposed from insulation on the conductors surrounding the exposed ends, and a conductive shield for covering the housing and cover block member, with a portion of the cover block member being opposite the shield and adapted to receive the conductors therealong, together with the exposed ends of the conductors and the insulation on the conductors, the conductors extending between the cover block member and the shield and the insulation on the conductors being between the exposed ends and the shield to prevent contact of the shield with the exposed ends.

3. An electrical connector as recited in claim 2 comprising: the shield providing a clamp to retain the cover block member and the housing together.

4. An electrical connector as recited in claim 2, comprising: the shield comprising backshells adapted to be attached together, and portions of the backshells providing strain relief for conductors connected to the terminals.

5. An electrical connector as recited in claim 2 comprising: said portion of the housing block member comprising grooves in a side of the cover block member facing the shield to receive therealong the conductors lengthwise and the exposed ends of the conductors and the insulation on the conductors.

6. An electrical connector as recited in claim 2, comprising: said portion of the housing block member comprising a side of the cover block member opposite the shield, and grooves in the side facing the shield, the grooves extending farther along the cover block member and being in alignment with the terminals to position the conductors in line with the terminals for connection therewith.

7. An electrical connector comprising: an insulating housing, an insulating cover block member, electrical terminals for connection to conductors having exposed ends of the conductors exposed from insulation on the conductors surrounding the exposed ends, and a conductive shield for covering the housing and cover block member, with a portion of the cover block member being opposite the shield and adapted to receive the conductors therealong together with the exposed ends of the conductors and the insulation on the conductors, and with the insulation on the conductors being between the exposed ends and the shield to prevent contact of the shield with the exposed ends, said portion of the cover block member comprising a first side of the cover block member opposite the shield, and grooves in the first side facing the shield, said grooves extending along a second side of the cover block member and being in alignment with the terminals to position the conductors for connection with the terminals, a third side of the cover block member opposite the shield, and said grooves extending along the third side facing the shield to position the conductors between the cover block member and the shield.

8. An electrical connectors comprising: an insulating housing, an insulating cover block member, electrical terminals for connection to conductors having exposed ends of the conductors exposed from insulation on the conductors surrounding the exposed ends, and a conductive shield for covering the housing and cover block member, with a portion of the cover block member being opposite the shield and adapted to receive the conductors therealong together with the exposed ends of the conductors and the insulation on the conductors, and with the insulation on the conductors being between the exposed ends and the shield to prevent contact of the shield with the exposed ends, a second portion of the cover block member in alignment with the terminals to position the conductors for connection with the terminals, and a third portion of the cover block member opposite the shield to position the conductors and the insulation on the conductors between the cover block member and the shield.

9. An electrical connector comprising: an insulating housing, an insulating cover block member, electrical terminals for connection to conductors, and a conductive shield for covering the housing and cover block member, a first side of the cover block member opposite the shield to position the conductors and the insulation on the conductors between the cover block member and the shield, a second portion of the cover block member in alignment with the terminals to position the conductors for connection with the terminals, and a third portion of the cover block member opposite the shield to position the conductors and the insulation on the conductors between the cover block member and the shield, and the shield being adapted to cover the conductors extending along the first and third portions of the cover block member.

10. An electrical connector as recited in claim 9, comprising: grooves to receive the conductors, the grooves extending continuously along the first, second and third sides of the cover block member, and the grooves along said first and third sides facing the shield.

* * * * *